US005718018A

United States Patent [19]

Ehrenkrona

[11] Patent Number: 5,718,018

[45] Date of Patent: Feb. 17, 1998

[54] VACUUM CLEANER BRUSH-ROLL NOZZLE

[75] Inventor: Bengt Ehrenkrona, Stockholm, Sweden

[73] Assignee: Aktiebolaget Electrolux, Stockholm, Sweden

[21] Appl. No.: 624,701

[22] Filed: Mar. 26, 1996

[30] Foreign Application Priority Data

Apr. 26, 1995 [SE] Sweden ..... 9501538

[51] Int. Cl.[6] ..... A47L 9/04

[52] U.S. Cl. ..... 15/392; 15/415.1

[58] Field of Search ..... 15/366, 383, 388, 15/392

[56] References Cited

U.S. PATENT DOCUMENTS

| | | | |
|---|---|---|---|
| 1,268,988 | 6/1918 | Mason | 15/388 X |
| 2,904,818 | 9/1959 | Sheahan | 15/388 |
| 2,949,624 | 8/1960 | Lampe | 15/388 X |
| 3,733,646 | 5/1973 | Mein | 15/388 X |

FOREIGN PATENT DOCUMENTS

| | | | |
|---|---|---|---|
| 124074 | 3/1919 | United Kingdom | 15/388 |

*Primary Examiner*—Chris K. Moore

*Attorney, Agent, or Firm*—Pearne, Gordon, McCoy & Granger LLP

[57] ABSTRACT

A nozzle for a vacuum cleaner including a brush-roll and wheels. The nozzle is partly supported above a surface being cleaned by the wheels. The brush-roll and the wheels are concentric with each other.

6 Claims, 1 Drawing Sheet

VACUUM CLEANER BRUSH-ROLL NOZZLE

BACKGROUND OF THE INVENTION

1. Field of the Invention

This invention relates to vacuum cleaners in general and, more particularly, to nozzles for use with vacuum cleaners wherein the nozzles have a rotatable brush-roll and front wheels upon which the nozzle is at least partially supported above a surface being cleaned.

2. Description of the Related Art

Nozzles of the type mentioned above are previously known and are used to clean different types of floor material. In such a nozzle, the brush-roll is supported above a suction opening of the nozzle and is driven by means of a mains-operated or a battery-operated electric motor. The wheels penetrate into a soft rug so the bristles of the brush-roll can work against the rug, whereas on a hard surface, the wheels safeguard the bristles of the brush-roll by not allowing the bristles to touch the surface, thereby permitting the nozzle to operate as a conventional nozzle without a brush-roll.

According to the arrangements previously known, the wheels are usually placed in front of the brush-roll which means that there is a comparatively large distance between the front edge of the nozzle and the suction opening. This means that the tips of the brush-roll bristles do not reach the surface close to walls or other vertical surfaces. The arrangement also means that the nozzle has large dimensions, which is also the case if the wheels are instead placed close behind the suction opening. A further drawback of the known arrangements is that it is often necessary to use small wheels in order to minimize the size of the nozzle. A small wheel does not always roll on the surface because the distance between the axis of the wheel and the friction surface of the wheel is so short that the friction force between the wheel and the surface being cleaned is not sufficient to rotate the wheel.

SUMMARY OF THE INVENTION

It therefore would be desirable, and is an advantage of the present invention, to provide a nozzle for a vacuum cleaner. The nozzle has a brush-roll that is rotatable and wheels upon which the nozzle is partly supported above a surface being cleaned. The brush-roll and the wheels are concentric with each other.

BRIEF DESCRIPTION OF THE DRAWINGS

The features, aspects, and advantages of the present invention will become better understood with regard to the following description, appended claims, and accompanying drawing where:

DETAILED DESCRIPTION OF THE PREFERRED EMBODIMENTS

Figure 1:
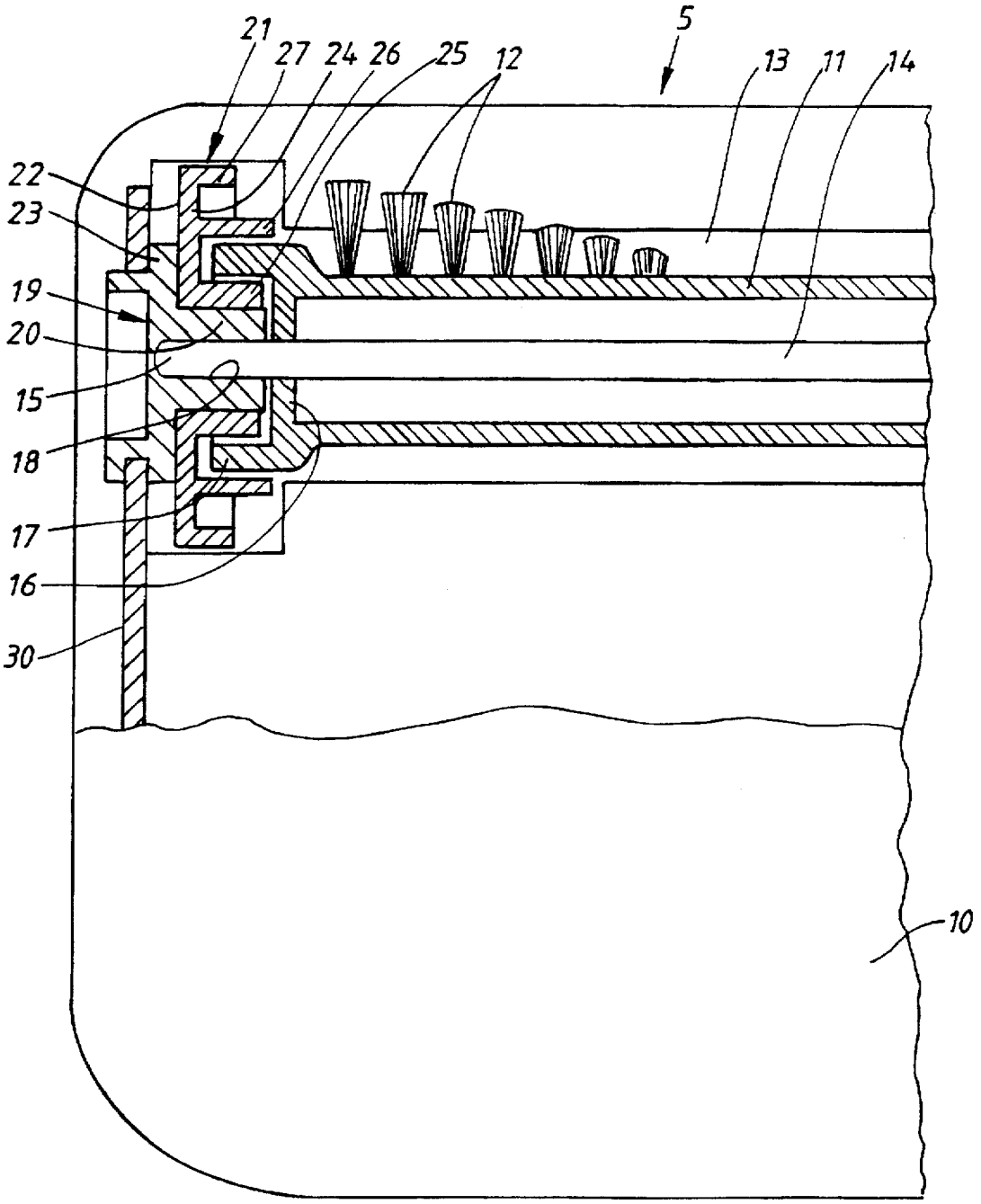
FIG. 1 shows a cut-away top sectional view of a portion of a nozzle embodied in accordance with the present invention.

It should be noted that in order to clearly and concisely disclose the present invention, the drawing may not necessarily be to scale and certain features of the invention may be shown in somewhat schematic form.

According to FIG. 1, a nozzle 5 comprises a shell 10, which in a conventional way can be connected to a vacuum cleaner hose via a tube connection and a tube shaft. The shell 10 surrounds a brush-roll 11 having bristles 12. The brush-roll 11 has opposing ends that are rotatably supported within the shell 10. The shell 10 has a pair of side walls 30 that are spaced outward from the opposing ends of the brush-roll 11. The nozzle 5 can also be provided with one or more rear wheels, which are not shown. The bottom side of the nozzle 5 has a suction opening 13 through which air flows into the nozzle 5. The brush-roll 11 is arranged in the nozzle 5 such that the tips of the bristles 12 extend through the suction opening 13. The opposing ends of the brush-roll 11 each have an end wall 16 surrounded by a sleeve-like part 17. The brush-roll 11 has a longitudinal shaft 14 that is secured to the end walls 16. The longitudinal shaft 14 has ends 15 that project outward from the end walls 16 and are surrounded by the sleeve-like parts 17.

A pair of bearing pieces 19 are secured to the side walls 30 of the shell 10 adjacent to the opposing ends of the brush-roll 11. The bearing pieces 19 are composed of plastic and have annular flanges 20 that surround and partially define recesses 18. The ends 15 of the longitudinal shaft 14 are rotatably supported within the recesses 18 in the bearing pieces 19. Accordingly, the brush-roll 11 is rotatable about an axis passing through the annular flanges 20. The outer surfaces of the annular flanges 20 are bearing surfaces around which a pair of wheels 21 are rotatably disposed. Since the wheels 21 are rotatable around the annular flanges 20 and the brush-roll 11 is rotatable about an axis passing through the annular flanges 20, the wheels 21 and the brush-roll 11 are co-axial or concentric. The wheels 21 and the brush-roll 11, however, rotate independent of each other.

The wheels 21 partially support the nozzle 5 above a surface being cleaned. The wheels 21 have diameters that are somewhat larger than the diameter of the brush-roll 11. The wheels 21, however, have a low profile because the wheels 21 extend into the suction opening 13. The wheels 21 each have an outer side 22 and an inner side 24. The outer sides 22 of the wheels 21 rest against shoulders 23 on the bearing pieces 19. The inner side 24 of each wheel 21 has circular flanges 25, 26, 27 that are concentric with each other. The circular flange 27 is located radially outward from the circular flange 26, which is, in turn, located radially outward from the circular flange 25. The circular flanges 25 are disposed inside the sleeve-like parts 17 of the brush-roll 11 and rest on the outer or bearing surfaces of the annular flanges 20, while the circular flanges 26 surround the sleeve-like parts 17. Thus, the circular flanges 25, 26 on the wheels 21 bracket the sleeve-like parts 17 on the brush-roll 11. It should be appreciated that with the outer sides 22 of the wheels 21 resting against the shoulders 23 of the bearing pieces 19 and the circular flanges 25, 26 on the inner sides 24 of the wheels 21 bracketing the sleeve-like parts 17 on the brush-roll 11, the wheels 21 are trapped between the brush-roll 11 and the bearing pieces 19.

The circular flanges 27 are located radially outward of the brushes 12 and function as friction surfaces or treads for the wheels 21. Thus, when the nozzle 5 is moved over a hard surface, the circular flanges 27 support the brushes 12 above the hard surface, thereby protecting the brushes 12. When the nozzle 5 is moved over a carpet, the circular flanges 27 sink into the carpet and permit the brushes 12 to engage the carpet and remove dirt particles adhering thereto. The large diameter of each wheel 21 increases the distance between the axis and the friction surface of the wheel 21, which, in turn, increases the friction force between the wheel 21 and the surface over which the nozzle 5 is being moved. This increase in friction force enables the wheels 21 to freely rotate over the surface.

Since the wheels 21 are concentric with the brush-roll 11, a compact arrangement is achieved that makes it possible to place the brush-roll 11 close to the front edge of the nozzle 5 while maintaining the supporting function of the wheels 21.

Although the preferred embodiment of this invention has been shown and described, it should be understood that various modifications and rearrangements of the parts may be resorted to without departing from the scope of the invention as disclosed and claimed herein.

What is claimed is:

1. A nozzle for use with a vacuum cleaner, said nozzle comprising:

a nozzle shell, a brush-roll, a pair of bearing pieces and wheels, said bearing pieces being secured to said nozzle shell and rotatably supporting said brush-roll and said wheels, said wheels at least partially supporting the nozzle shell above a surface being cleaned, said brush-roll and said wheels being concentric with each other, wherein the brush-roll has opposing ends with end walls and a shaft having ends, said shaft ends projecting outward from the end walls, wherein each of the bearing pieces includes a flange surrounding a recess in which one of the ends of the shaft is supported and having a cylindrical outer surface upon which one of the wheels is journaled.

2. The nozzle according to claim 1 wherein each of the bearing pieces further comprises a shoulder adjoining the flange and against which one of the wheels rests.

3. A nozzle for use with a vacuum cleaner, said nozzle comprising a nozzle shell, a brush-roll, and wheels, said brush-roll having opposing ends with end walls and a shaft having ends that project outward from the end walls, each of said wheels comprising plurality of concentric flanges, and wherein the brush-roll further comprises sleeve-like parts surrounding the end walls, each of said sleeve-like parts being disposed between two of said plurality of concentric flanges.

4. The nozzle according to claim 3, further comprising bearing pieces, said brush-roll and wheels both being supported by the bearing pieces.

5. The nozzle according to claim 4, wherein each of the bearing pieces comprises a flange surrounding a recess in which one of the ends of the shaft is supported and having a cylindrical outer surface upon which one of the wheels is journaled.

6. The nozzle according to claim 4 wherein each of the bearing pieces further comprises a shoulder adjoining the flange and against which one of the wheels rests.

* * * * *